United States Patent [19]

Greenberger

[11] 4,453,324

[45] Jun. 12, 1984

[54] PRICING SIGN WITH CHANGEABLE NUMBERS

[75] Inventor: William Greenberger, White Plains, N.Y.

[73] Assignee: The Hopp Press, Inc., New York, N.Y.

[21] Appl. No.: 459,686

[22] Filed: Jan. 20, 1983

[51] Int. Cl.[3] ..... G09F 3/20

[52] U.S. Cl. ..... 40/5; 40/10 R; 40/16.2; 40/124.4

[58] Field of Search ..... 40/10 R, 5, 11 R, 16.2, 40/16.4, 124.2, 124.4, 508, 510, 511, 529

[56] References Cited

U.S. PATENT DOCUMENTS

| | | | |
|---|---|---|---|
| 498,053 | 5/1893 | Gildemeyer | 40/5 |
| 1,824,794 | 9/1931 | Rohlfes | 40/5 |
| 1,910,476 | 5/1933 | Rulong | 40/10 R |
| 2,202,268 | 5/1940 | Rohlfes | 40/5 |
| 2,588,635 | 3/1952 | Junkin | 40/16.2 |
| 2,626,472 | 1/1953 | Stingl | 40/5 |
| 2,770,898 | 11/1956 | Lutz et al. | 40/5 |
| 3,673,718 | 7/1972 | Bernard | 40/5 |
| 3,903,629 | 9/1975 | Gruna | 40/5 |
| 4,296,563 | 10/1981 | Clement | 40/5 |
| 4,334,372 | 6/1982 | Colmar | 40/5 |

FOREIGN PATENT DOCUMENTS

| | | | |
|---|---|---|---|
| 2746118 | 4/1978 | Fed. Rep. of Germany | 40/16.2 |

*Primary Examiner*—Gene Mancene
*Assistant Examiner*—James Hakomaki
*Attorney, Agent, or Firm*—Kane, Dalsimer, Kane, Sullivan & Kurucz

[57] ABSTRACT

This invention relates to a display device having a self storing changeable message appearing on a display element that may be folded for insertion into a mounting member having two opposing flanges defining a channel and when the display element is engaged with the channel a selected portion of message printed thereon is displayed.

6 Claims, 5 Drawing Figures

FIG.1
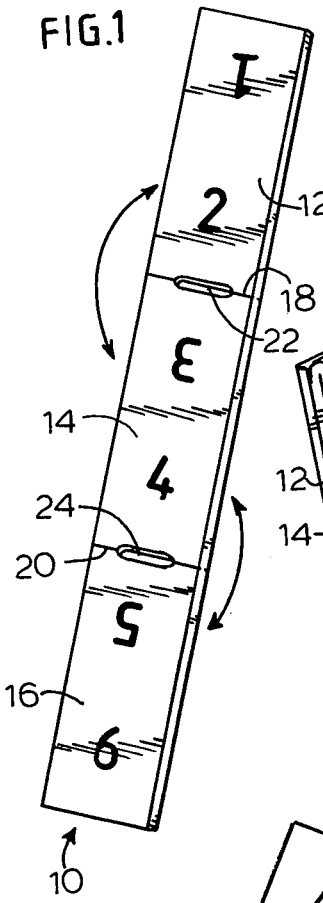
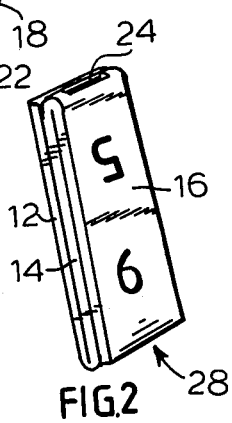
FIG.2
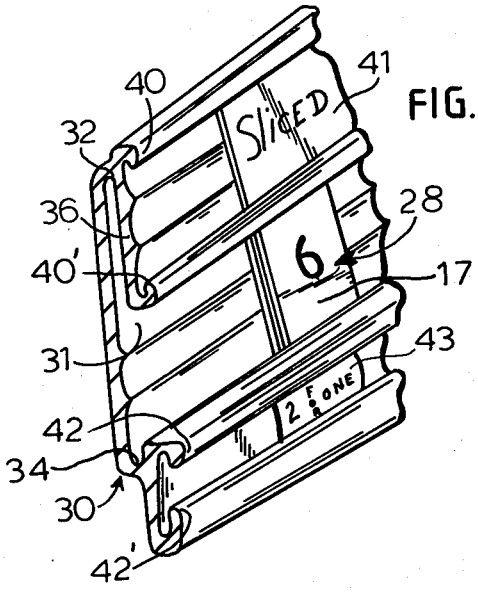
FIG.3
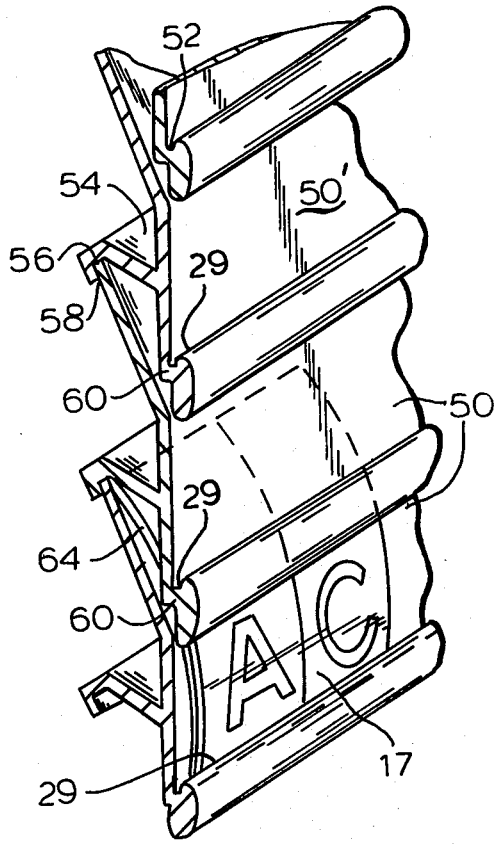
FIG.4
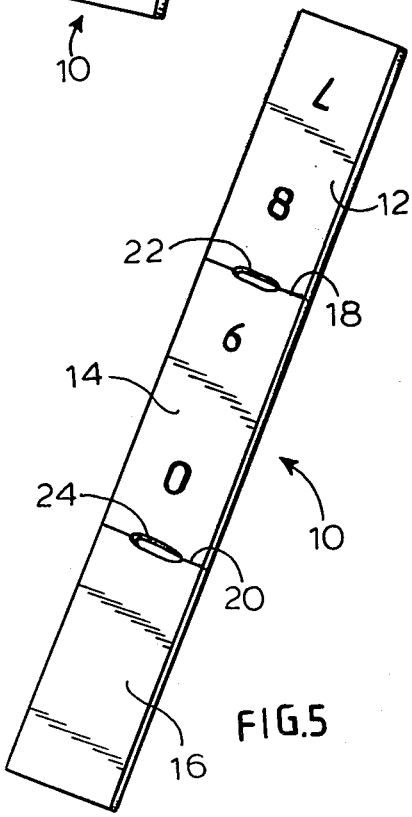
FIG.5

PRICING SIGN WITH CHANGEABLE NUMBERS

BACKGROUND OF THE INVENTION

The field of this invention is display signs and in particular, signs having a channel mount that conceals a substantial portion of cooperating removable information panels.

DESCRIPTION OF THE PRIOR ART

Signs having changeable elements, eg. panels, tags, etc. that cooperate with a mounting member by engaging the periphery of the element with flanges that define the channel are well known. For example, see U.S. Pat. Nos. 3,081,568; 4,179,138. Such devices are particularly useful for displaying information that is subject to periodic change, eg. prices and the like.

A long standing problem with such signs is that a separate element for each piece of information must be provided and separately stored when not in use.

SUMMARY OF THE INVENTION

The present invention provides a display device having a self-storing changeable message which comprises a mounting member having two opposing flanges defining a channel therebetween and a cooperating display element having information thereon. The display element is adapted to engagement with said flanges and at least one said flange covers a selected portion of the information on said display element. In one embodiment the display element is a foldable resilient sheet preferably having three segments each segment having two sides provided with information thereon. When this element is inserted in the channel member only about one half of the information on one side of a segment is visible and the remaining information on that segment is concealed by an extended portion of a flange.

It is an object of the present invention to provide a display device having easily changeable self-storing information elements.

It is a further object of the present invention to provide an inexpensive, easily manufactured display device.

It is a further object of the present invention to provide a display device which at all times is entirely self-contained eliminating need for separate indexed or compartmented box of extra display elements, eg. numerals and tabs, to make up price changes.

BRIEF DESCRIPTION OF THE DRAWING

With the above and other incidental objects in view as will more fully appear in the specification, the invention intended to be protected by Letters Patent consists of the features of construction, the parts and combinations thereof and mode of operation as hereafter described or illustrated by the accompanying drawings, or their equivalents.

Referring to the drawings wherein some but not necessarily the only forms of the present invention are illustrated.

FIG. 1, is an isometric view of a foldable display element having three segments.

FIG. 2, is an isometric view of the display element of FIG. 1 folded.

FIG. 3, is an isometric view of a channel member having a folded display element inserted therein.

FIG. 4, is an isometric view of a alternate embodiment of the present invention having cooperating channel elements.

FIG. 5, is an isometric view of the reverse side of the display element of FIGS. 1 and 2.

Like parts are indicated by the same reference numerals throughout the drawings.

DETAILED DESCRIPTION OF PREFERRED EMBODIMENTS

The element of the present invention illustrated in FIGS. 1,2,3 and 5 comprises a display element 10 formed from a sheet, preferably resilient sheet, having three foldable segments 12, 14, and 16 each provided with information, ie. numerals, printed on both sides thereof. The two creases 18 and 20 that divide segments 12, 14, and 16 bend when the resilient sheet 10 is folded as shown in FIG. 2 and openings 22 and 24 are optionally provided along the creases 18 and 20 to add flexibility to the hinge formed by bending and render a flatter folded form 28. Many modern plastic materials may be bent or folded, as contemplated, many thousands of times without cracking or breaking. It will be appreciated that the number of segments per display element can be varied from one up to several depending on the thickness of the resilient sheet 10 and dimensions of the mounting member 30. The mounting member 30 defines a channel 31 boarded by first and second flanges 32 and 34, respectively. The flange members 32 and 34 engage portions of the periphery of folded display element 28 when it is seated in the channel 31. The outer extended portion 36 of first flange 32 extends downwardly covering approximately one-half of the exposed surface 17 of segment 16 so that only the single numeral six of the seated display element 10 is visible. If the display element 10 is inverted only the numeral five will be seen; if reversed, either the numerals seven or eight appear on the reverse side, shown in FIG. 5, and so on so that each numeral may be individually displayed. It will be appreciated that other information including any symbol or pictorial, eg. letters of the alphabet, words, dollar & cents signs etc. may be substituted for the numerals, in the above example, and that a plurality of display elements in a single mounting member may cooperate to display any desired message. It will be appreciated that the entire alphabet and the numerals zero thru nine can be put on three reversible strips having three segments each. Moreover, a blank portion of one or more segments may be provided so that the display element may be stored in channel 31 without displaying any information. It will be appreciated that the display elements may be easily modified to fit in a cooperating channel with its creases orientated vertically rather than the horizontal orientation shown in the drawings.

Preferably, each of the exterior surfaces of the flanges 32 and 34 are provided with a pair of cooperating flanges 40 40′ and 42, 42′ defining a simple channel that is adapted to accommodate in any known manner, conventional type display elements 41 and 43 having a message or portion thereof on at least one side.

The embodiment illustrated in FIG. 4 utilizes the same type display elements described above and the structure of the mounting element 50 is modified so that two or more such modified elements 50 cooperate with each other to form a structure that otherwise functions in the same manner as the previously described embodiment. Mounting element 50 is provided with a flange 52 on its forward surface for receiving the periphery 29 of the display element 64 seated therein. The opposite or rearward side of the modified mounting element 50 is provided with a specially adapted shoulder 54 the lower portion of which defines a seat for the upper rearwardly inclined portion 58 of a second element 50'. The rearwardly inclined upper portion 58 of first element 50 and the lower portion 60 of a second cooperating element 50' define a flange-like pocket 62 that functions in substantially the same manner as the extended portion 36 of flange 32, described above. That is, it secures portions of the periphery of the folded display element 64 and conceals approximately half of its exposed surface so that only a selected portion of the information thereon is visible.

From the above description, it will be apparent that there is thus provided a device of the character described possessing the particular features and advantages described herein, but which obviously is susceptible of modification in its form, proportions, details of construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but a few of several modes of putting the invention into effect and the invention is therefore claimed in any of its forms or modifications within the legitimate and valid scope of the appended claims.

What is claimed is:

1. A display device having a self-storing changeable message, which comprises:

a mounting member having a forward surface provided with a channel defined by two flanges;

a cooperating display element comprising a foldable sheet having at least two segements bearing information for display and adapted to being inserted into said channel and engagement with said flanges so that information on a selected segment is displayed; and at least one of said flanges having an extended portion that conceals a selected portion of the information on the display element.

2. The display device recited in claim 1, wherein:

the foldable sheet has three segments.

3. A display device having a self-storing changeable message, which comprises:

a first mounting member having an upper and lower forward surface and a rear surface;

a flange provided on the lower forward surface and a shoulder provided on the rear surface;

a second mounting member having second upper and lower forward surfaces and a second rear surface;

a second flange provided on the second lower forward surface and a second shoulder provided on the second rear surface;

the second shoulder is adapted to engagement with the first mounting member so that an upper flange may be formed by the forward upper surface of the first mounting member and the second rear surface; and, a cooperating display element comprising a foldable sheet having at least two segments bearing information for display and adapted to engagement with the upper and lower flanges so that a portion of the information thereof is concealed by the second lower forward surface of the second mounting member.

4. The display device recited in claim 3, wherein:

the foldable sheet has three segments.

5. The display device recited in claims 2, 3, or 4 further comprising:

at least one opening is disposed between the segments of the display element to facilitate bending.

6. The display device recited in claims 1, 2, 3, or 4 further comprising:

at least one auxiliary channel defined by two flanges disposed on the forward surface of a mounting member.

* * * * *